US012092413B2

(12) United States Patent
Wutte et al.

(10) Patent No.: US 12,092,413 B2
(45) **Date of Patent: *Sep. 17, 2024**

(54) FIREARM WITH BARREL CLAMP

(71) Applicant: GLOCK TECHNOLOGY GMBH, Ferlach (AT)

(72) Inventors: Andreas Wutte, Ferlach (AT); Elmar Bilgeri, Klagenfurt (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 92 days.

This patent is subject to a terminal disclaimer.

(21) Appl. No.: 17/754,449

(22) PCT Filed: Sep. 28, 2020

(86) PCT No.: PCT/EP2020/077111

§ 371 (c)(1),
(2) Date: Apr. 1, 2022

(87) PCT Pub. No.: WO2021/063891

PCT Pub. Date: Apr. 8, 2021

(65) Prior Publication Data

US 2022/0341696 A1 Oct. 27, 2022

(30) Foreign Application Priority Data

Oct. 4, 2019 (EP) ..... 19201455

(51) Int. Cl.
*F41A 21/48* (2006.01)

(52) U.S. Cl.
CPC ..... *F41A 21/484* (2013.01); *F41A 21/487* (2013.01)

(58) Field of Classification Search
CPC ..... F41A 21/487
USPC ..... 42/75.02
See application file for complete search history.

(56) References Cited

U.S. PATENT DOCUMENTS 2,455,608 A * 12/1948 Rosengren ..... F41A 21/484 42/75.01
5,155,284 A * 10/1992 Flashkes ..... F41A 21/484 42/75.02
6,470,617 B1 * 10/2002 Gregory ..... F41A 11/04 42/75.02
7,313,883 B2 1/2008 Leitner-Wise
(Continued)

FOREIGN PATENT DOCUMENTS

DE 102009051416 A1 7/2010
DE 10201000061 A1 9/2011
(Continued)

*Primary Examiner* — Bret Hayes
(74) *Attorney, Agent, or Firm* — Raven Patents, LLC; Anton E. Skaugset

(57) ABSTRACT

A firearm with a clamping device for attaching a barrel with a barrel extension, where the barrel extension on the one hand, and a seat on the other hand, possibly directly the upper receiver, are connected to one another by means of a clamp and the fixing of the barrel extension on the upper receiver by means of a tension lever that is rotatable about a common axis of rotation running normal to the weapon center plane between two end positions, the ready-to-fire position and the dismantling position, with at least one clamping section and a grip and a cam formed on the tension lever.

20 Claims, 11 Drawing Sheets

(56) References Cited

U.S. PATENT DOCUMENTS

| | | | | |
|---|---|---|---|---|
| 7,823,314 | B1 * | 11/2010 | Wheatley | F41A 21/484 89/14.4 |
| 8,087,194 | B1 * | 1/2012 | Vuksanovich | F41A 21/481 42/75.01 |
| 8,813,406 | B1 | 8/2014 | Sullivan | |
| 8,973,483 | B2 | 3/2015 | Sullivan | |
| 9,038,525 | B2 | 5/2015 | Sullivan | |
| 9,228,786 | B2 | 1/2016 | Sullivan | |
| 9,488,423 | B2 | 11/2016 | Sullivan | |
| 10,704,852 | B2 * | 7/2020 | Michut | F41A 11/02 |
| 11,333,460 | B2 * | 5/2022 | Wutte | F41A 21/481 |
| 2008/0289238 | A1 * | 11/2008 | Lippard | F41A 5/04 42/75.02 |
| 2010/0281742 | A1 | 11/2010 | Barrett | |
| 2015/0308779 | A1 | 10/2015 | McGinty | |
| 2021/0278169 | A1 * | 9/2021 | Zinsner | F41C 23/16 |

FOREIGN PATENT DOCUMENTS

| | | | | |
|---|---|---|---|---|
| DE | 102010000617 | A1 | 9/2011 | |
| DE | 202012101602 | U1 | 6/2012 | |
| DE | 102011114686 | B3 | 3/2013 | |
| EP | 2363678 | A2 | 9/2011 | |
| EP | 2663826 | A2 | 11/2013 | |
| EP | 2913622 | A1 | 9/2015 | |
| EP | 3800434 | A1 * | 4/2021 | F41A 21/481 |
| FR | 386646 | A | 6/1908 | |
| FR | 412523 | A | 7/1910 | |

* cited by examiner

FIREARM WITH BARREL CLAMP

TECHNICAL FIELD

The present disclosure relates generally to firearms, and more particularly to clamping devices that secure a firearm barrel or barrel extension in the firearm receiver.

BACKGROUND

In recent years, military, law enforcement, and civilian users have increasingly demanded the ability to replace the barrel of a rifle without great effort. This can be done, for example, in order to be able to use barrels of different lengths or barrels with different calibers, in which the barrel axis/bore maintains its position in the upper receiver for each caliber. In the latter case, changes may have to be made to the locking mechanism and/or the lower receiver.

EP 2 363 678, corresponding to DE 10 2010 000 617, proposes connecting the barrel to a barrel extension, for example by means of a thread. This barrel extension fits into a circular cylindrical bore in the receiver (upper part) and is fixed by means of a rotatable eccentric. During the dismantling process, a front part of the pin, called a pin head, is pulled out of the receiver together with the barrel, which makes it difficult to change the barrel. The circular cylindrical bearing of the barrel, the angular position of which is only determined by a flat that interacts with the eccentric and which is always imprecise, and the "entrainment" of the pin head are extremely disadvantageous and lead to rapid wear and noticeable inaccuracies when used roughly.

EP 2 663 826, corresponding to U.S. Pat. Nos. 9,228,786, 8,813,406, 8,973,483, 9,038,525 and 9,488,423, the content of these five US documents is hereby incorporated by reference for all purposes, comprising in each case over 140 pages with over 80 figures, which are mostly further subdivided into views A-F, best seen in FIGS. 52A-53C a connection of a barrel with a so-called "backbone" arranged above the barrel by means of a lever. The lever consists of two angles, which are arranged on the left and right of the backbone parallel to the weapon center plane and are connected to one another by means of a web, which also serves as an axis. On its upper side, the backbone has a notch running transversely to the axis of the barrel, onto or into which the web is placed from above. The barrel has on its top left and right an area of attack for the lever, which also comprises a prismatic notch and is pressed against the circular cylindrical surface of the backbone when the lever is pulled. The assembly movement between the barrel and the backbone takes place exclusively normal to the barrel axis, which is ensured by two additional contact points axially in front of and behind the lever.

In the assembled state, the barrel and the backbone are therefore in contact with one another in three places. The relative position of the two components is determined by the notch for the web, the contact between the prism that is a few millimeters long and the cylindrical surface of the backbone and other two contact points, which are purely form-fitting and therefore determined as a function of tolerance. In rough operation, such a design is not able to reach an exact position reliably and with repeat accuracy. There is also a risk that the lever will be lost as it is a loose and not overly large individual part.

U.S. Pat. No. 7,313,883, hereby incorporated by reference for all purposes, proposes to use the barrel with attached aiming devices and possibly mounted accessories (laser, light, etc.) to be held on the receiver by means of a mounting part that is firmly connected to the barrel and optionally formed in one piece with said barrel. This connection is achieved by means of two opposing toggle levers that clamp the fitting surfaces of the mounting part between them. It is particularly emphasized that the barrel is mounted in a "free floating" manner, which means that its position is determined by the forces acting on the two levers. This is probably sufficient for the contemplated "Squad Assault Weapons (SAW)," which are used at the shortest possible distance, but not for other areas of application.

US 2010/281742, hereby incorporated by reference for all purposes, proposes for a rifle a dismantling of the barrel that is similar to that of the first-mentioned documents: a circular cylindrical receiver with a fixing toggle lever and all the resulting problems.

It is known from DE 10 2009 051 416 to firmly connect the barrel to an extension that supports the actual connecting parts to the receiver, called the "lock box." During assembly, the rear end of the extension, which is convex-rounded and inclined, is pushed into a complementary, concave recess of the receiver and pressed together with a toggle lever backwards in the running direction and attached. The relative position of the two parts is several times overdetermined and unfavorable for long-term dimensional accuracy due to the rounding, even when produced with modern, precise methods.

DE 10 2011 114 686, DE 20 2012 101 602 U and EP 2 913 622 propose slightly different solutions, i.e. to clamp the barrel with a circular cylindrical outer contour in a slotted extension with a circular cylindrical inner contour, which requires a purely force-fit and thus unreproducible position.

US 2015/308779, hereby incorporated by reference for all purposes, discloses the assembly of a barrel in a circular cylindrical ring in the receiver, with a type of flap on the underside of the receiver being pushed backwards when closing a collar of the barrel and with the underside and side areas in the rear section of the barrel being fixed by corresponding flank parts of the flap. Here, too, the accuracy of the attachment is inadequate, especially given the aforementioned significant heating of all components.

All the previously known solutions therefore have disadvantages, which relate particularly to the positioning that cannot be maintained during use, when heated, and usually also the risk of losing small parts such as fixing pins or screws. There is thus a need for a reliable, accurate, reproducible and yet simple and robust solution to the problem of changing the barrel in an upper part of a carbine.

SUMMARY

The present disclosure is directed to firearms having a clamping device for a barrel or its barrel extension in a receiver of the firearm. The so-called upper receiver of the carbine contains at least one barrel with a barrel extension, a tension lever group, a locking mechanism, a firing pin mechanism, possibly a gas mechanism and a cover. This upper receiver is detachably connected to a lower receiver which contains, in general, a grip, a magazine well/holder and a trigger mechanism. In the assembled, ready-to-fire state, the latter is in an operative connection with the firing pin mechanism.

In one example, the present disclosure includes a firearm having an upper receiver, including at least one barrel having a barrel axis, a barrel extension that can be firmly connected to the barrel, a locking mechanism, and a firing pin mechanism; and a lower receiver, including at least one grip, a magazine, and a trigger mechanism; where the firearm is configured so that when the firearm is in an assembled and ready-to-fire state the upper receiver and the lower receiver are connected to one another; where the barrel extension is connected directly to the upper receiver using a clamp, or the barrel extension is connected to the upper receiver via a seat using the clamp; where the barrel extension defines a prism, and the clamp defines corresponding prismatic guide surfaces running parallel to the barrel axis when the firearm is in the assembled and ready-to-fire state; the barrel extension is fastened on the upper receiver by a tension lever, the tension lever being rotatable in the upper receiver about a common axis of rotation that extends normal to a weapon center plane between two end positions corresponding to the assembled and ready-to-fire position and a dismantling position, the tension lever further including at least one clamping section, an elongated grip, and a cam formed on the tension lever; the clamp and the tension lever are connected by a pin along the common axis of rotation through at least one clamping lever hole that extends normal to the weapon center plane; when the firearm is in the assembled and ready-to-fire position, the barrel extension rests with a rear stop surface on the seat, so that the barrel extension is clamped backwards by the cam against a forward direction of travel, and the clamping section biases the clamp in a vertical direction; and when the firearm is in the dismantling position, the clamping section and the cam lie entirely outside a path of movement of the barrel extension in the forward direction of travel.

BRIEF DESCRIPTION OF THE DRAWINGS

The following description of the drawings address in further detail various exemplary embodiments of the present disclosure as well as possible modifications. The barrel clamp of the present disclosure is explained in more detail below with reference to the drawings, in which.

DETAILED DESCRIPTION

Figure 1:
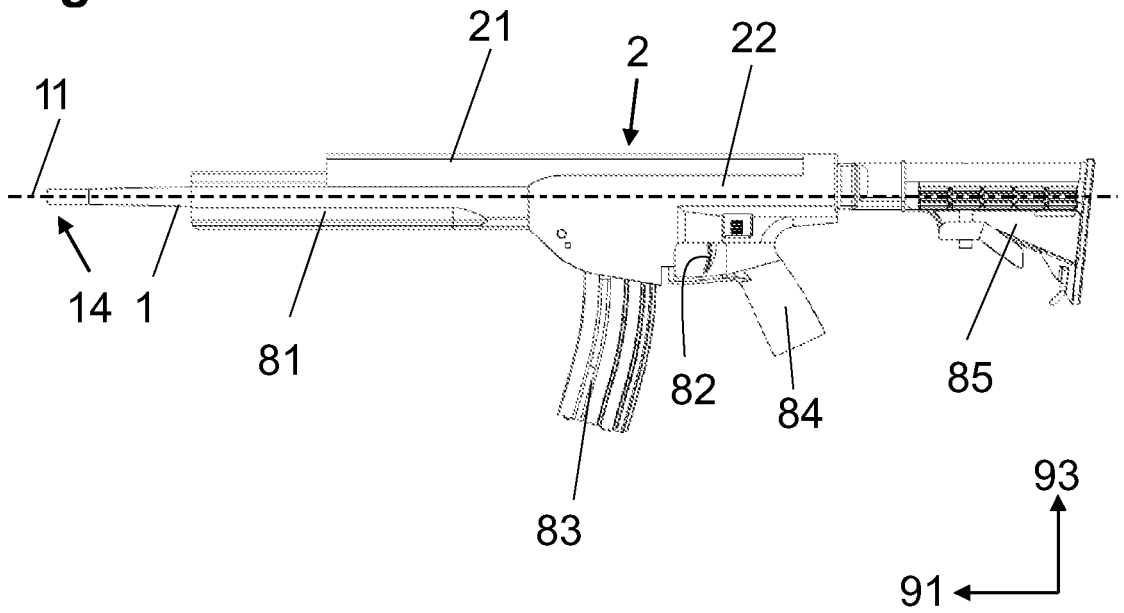
FIG. 1 shows a simplified representation of a firearm.

As used herein, the term firearm includes any long gun, such as a rifle, but can additionally refer to carbines, repeating rifles, and the like, without limitation.

The terms left, right, up, down, front and back in the present disclosure always refer to the firearm from the point of view of the firearm when it is held ready to fire. The weapon has, going through the barrel axis and oriented vertically, a weapon center plane, which, cum grano salis, forms a plane of symmetry.

In the description and the claims, the terms "front," "rear," "above," "below" and so on are used in the generally accepted form and with reference to the object in its usual use position. This means that, for the firearm, the mouth of the barrel is "at the front," that the breech is moved "rearward" by the explosive gas, etc. Transverse to a direction substantially means a direction rotated by 90°.

In the accompanying drawings, the forward direction of travel is indicated by the arrow 91, the normal vertical direction by the arrow 93 and the transverse direction to the left by the arrow 92.

It is an aim of the present disclosure to provide a solution to the various drawbacks of the barrel clamping devices of the prior art. This is done according to the present disclosure via one or more of the features described below where the barrel extension defines a prism that is a solid polyhedron whose ends are the same size and shape and are parallel to one another, and whose sides are parallelograms that are prismatic guide surfaces running parallel to the barrel axis. On the one hand, the barrel extension and, on the other hand, a seat, possibly the upper receiver itself, are connected to one another by means of a clamp with the barrel extension and the clamp having prismatic guide surfaces that correspond to one another in the mounted, ready-to-fire state of the weapon and that run parallel to the barrel axis and the fastening of the barrel extension on the upper receiver being achieved by means of tension levers that are, in the upper receiver, rotatable about an axis of rotation running normal to the weapon center plane in the upper receiver between two end positions, the ready-to-fire position and the disassembly position.

The tension lever has at least one clamping section, a grip and a cam (or nose). A pin is used to connect the clamp and the tension lever along the axis of rotation, through at least one clamping lever hole formed normal to the weapon center plane. In the ready-to-fire position, the barrel extension can thus rest against the seat with a rear stop surface and be tensioned backwards by the cam counter to the running direction while the clamping section simultaneously exerts a bias on the clamp in the vertical direction. In the dismantling position, the clamping section and the cam are entirely outside the movement path of the barrel extension in the direction of travel.

In other words, a barrel extension is clamped by means of a clamp, which is mounted so as to be displaceable in the vertical direction, in a seat of the receiver or, if necessary, directly on the receiver. The barrel extension and the clamp have mutually corresponding prismatic guides. The guides are designed in such a way that they are substantially complementary in shape and to run parallel to the barrel axis in the mounted, ready-to-fire state of the weapon. The barrel extension is attached or released on the upper receiver between two end positions, the ready-to-fire position and the dismantling position, by means of a tension lever that can be rotated in the upper receiver about an axis of rotation normal to the weapon center plane, with at least one clamping section and a grip and a cam formed on the tension lever. A pin is provided to connect the clamp and the tension lever laterally, transversely to the weapon center plane, along an axis of rotation.

The clamp and the tension lever comprise at least one clamping lever hole that is normal to the weapon center plane, the axes of which coincide with the axis of rotation. In the ready-to-fire position, the barrel extension rests with a rear stop surface on the seat, or directly on the receiver, and is braced backwards by the cam against the direction of travel, while the clamping section biases the clamp in the vertical direction relative to the seat. In the dismantling position, the clamping section and the cam are entirely outside of the movement path of the barrel extension in the direction of travel, as a result of which the barrel and the barrel extension are released.

In the ready-to-fire state, the prismatic guide surfaces, namely the prism surface of the barrel extension and the clamping surface of the clamp, are braced against each other in the vertical direction. The corresponding prismatic guide surfaces can reduce the local surface pressure on the barrel extension and thus avoid local stress peaks on the barrel and any warping of the barrel, thus promoting the precision of the firearm. In this way, a positioning of the barrel relative to the upper receiver is possible with repeat accuracy. A relatively simple, but precise vertical and axial alignment and bracing in the upper receiver can be achieved by means of fewer moving parts. To put it simply, the barrel can be clamped by pressing an eccentric clamping section against the fixed support in the upper receiver or directly against the upper receiver when the tension lever is turned over, whereby the clamp is pulled down and the barrel extension is positioned fixed to the receiver.

In a particularly preferred embodiment, the seat has at least one slotted hole, whereby an additional guide for the clamp is formed in the vertical direction.

Further preferred embodiments include, for example, the formation of a slotted barrel extension, the shape and arrangement of, for example, cam, lugs, and various recesses, whereby a particularly stable mounting of the barrel and/or a small size of the clamping device are made possible and/or manufacturing advantages can be used.

FIG. 1 schematically shows a firearm, which may comprise a barrel 1 with barrel axis 11 and muzzle 14, a receiver 2 with the upper receiver part 21, also called the upper receiver, and the lower receiver part 22, also called the lower receiver, a handguard 81, a trigger 82, a magazine well/holder 83, a grip 84 and a buttstock/shaft 85. A locking device with a locking seat and locking head, a spring-loaded return device, a possible gas system and the like are not shown in more detail for example, because they are self-explanatory for a person skilled in the art with knowledge of the present disclosure.

Figure 2A:
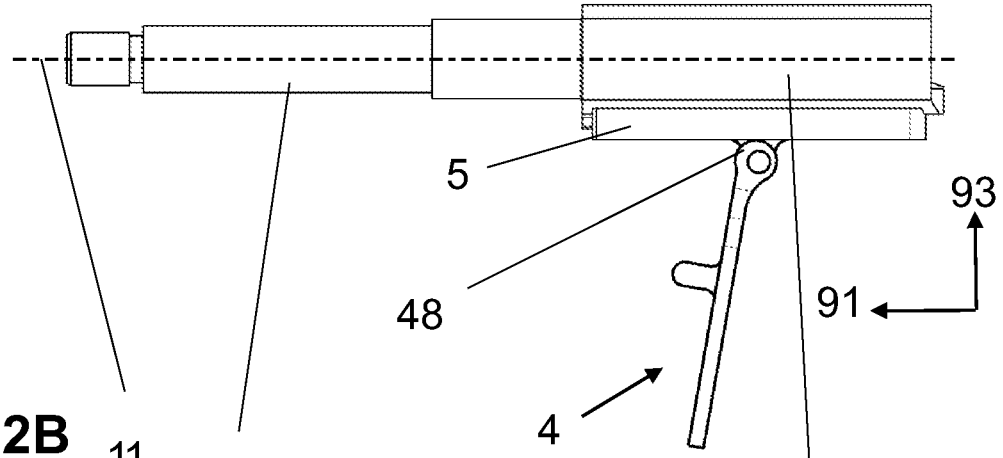
FIGS. 2A and 2B show a simplified representation of an illustrative clamping device in the open state.
Figure 2B:
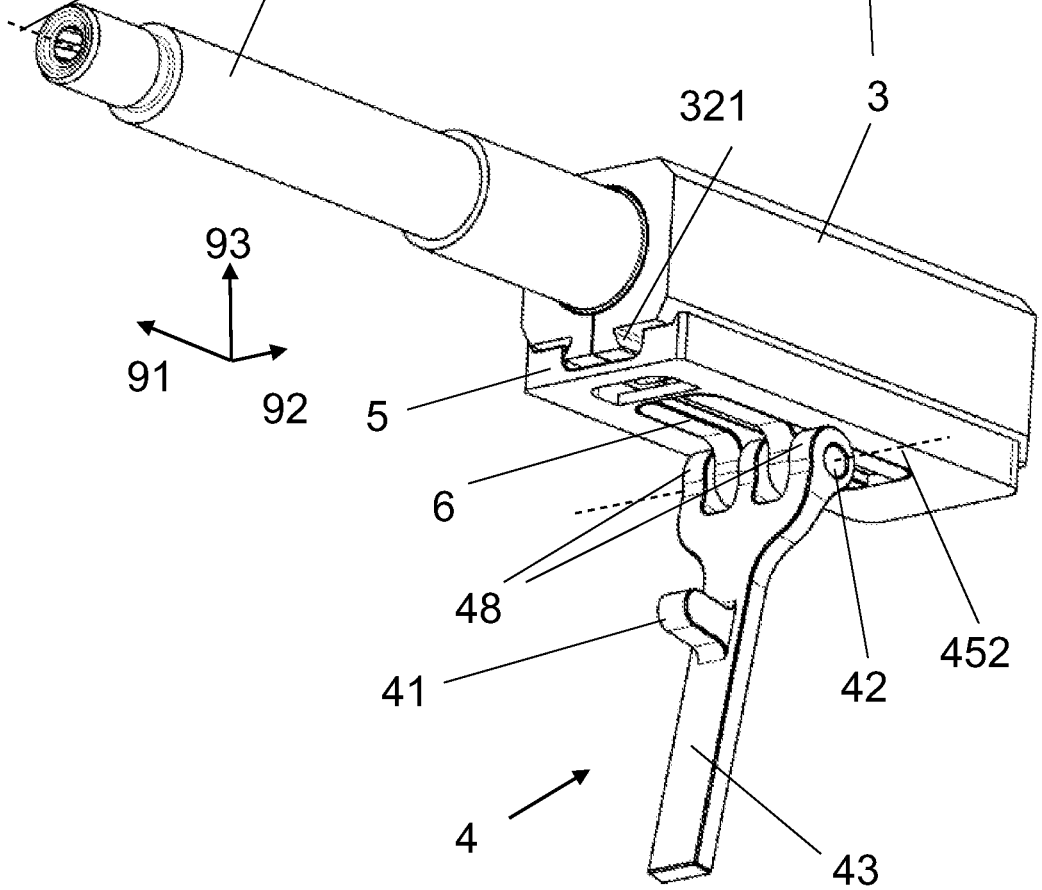

FIG. 2A shows the clamping device in the open state, i.e., for the disassembly/assembly of the barrel 1 or barrel extension 3 by way of example in a side view, and FIG. 2B shows the clamping device in a perspective view obliquely from below. The receiver 2 is not shown for the sake of simplicity. However, when viewed together with FIG. 1, it is easy to understand that the tension lever 4 can only be opened when the receiver 2 is open, i.e., when the upper receiver 21 and the lower receiver 22 are separated. This aspect will be explained later. In addition, it is easy to understand that the barrel 1, or the barrel extension 3, is introduced into the upper receiver 21 from the front against the barrel direction 91.

A common axis of rotation 452 of the tension lever 4 and the clamp 6, which is defined by the respective bores, i.e., at least one clamping lever hole 45 and at least one clamp hole 65, is provided for the operation of the clamping device, which will be explained in more detail later. In simple terms, the formation of at least one clamping section 48 on the tension lever 4 in the closed state, i.e., in the ready-to-fire position, causes an elastic tensioning of the clamp 6 relative to the seat 5, whereby, via prismatic guide surfaces 321, 62 on the barrel extension 3 and the clamp 6, the barrel extension 3 is fixed with respect to the barrel 1. In the open state of the clamping device, the barrel 1 or the barrel extension 3 can be dismantled/assembled quickly and relatively easily since no components block the insertion or withdrawal in the forward direction of movement 91.

This basic idea is very easy to see in FIGS. 2A and 2B. The tension lever 4 and the clamp 6 are held on the common axis of rotation 452 by a pin 42 or an equivalent fastening means. The tension lever 4 has at least one clamping section 48 which, as can be clearly seen in FIG. 2A, is supported on the underside of the seat 5. By turning over the tension lever 4, as will be explained in detail later, the clamp 6 is pulled downward in the vertical direction and the barrel extension 3 is thus clamped against the seat 5 and/or the receiver 2 (not shown). The clamp 6 is guided in the clamp receptacle 58. In addition, the clamp 6 is secured against falling out downwards by the suitable design of the clamp receptacle 58 or the clamp 6.

For reasons of easier readability and brevity, the following illustration is reduced to one or more preferred embodiments, which are intended to make it easier for a person skilled in the art to easily grasp the variety of design options and modifications of the present disclosure. It is later up to the person skilled in the art, knowing the present disclosure, to optimize the shape and number of the components involved in the clamping device, such as the bores, lugs, prismatic guide surfaces and the like.

In particular, it should be pointed out that the following discussion is reduced to a preferred embodiment with slotted holes 55 on the seat 5, since in certain cases it may be advantageous to form a slotted hole on the seat. This way, for example, the installation play during the dismantling/assembly, i.e. an easier insertion of the barrel extension 3 into the clamp 6, can be increased. The common axis of rotation 452 accordingly runs within at least one slotted hole 55 on the seat 5.

Figure 3:
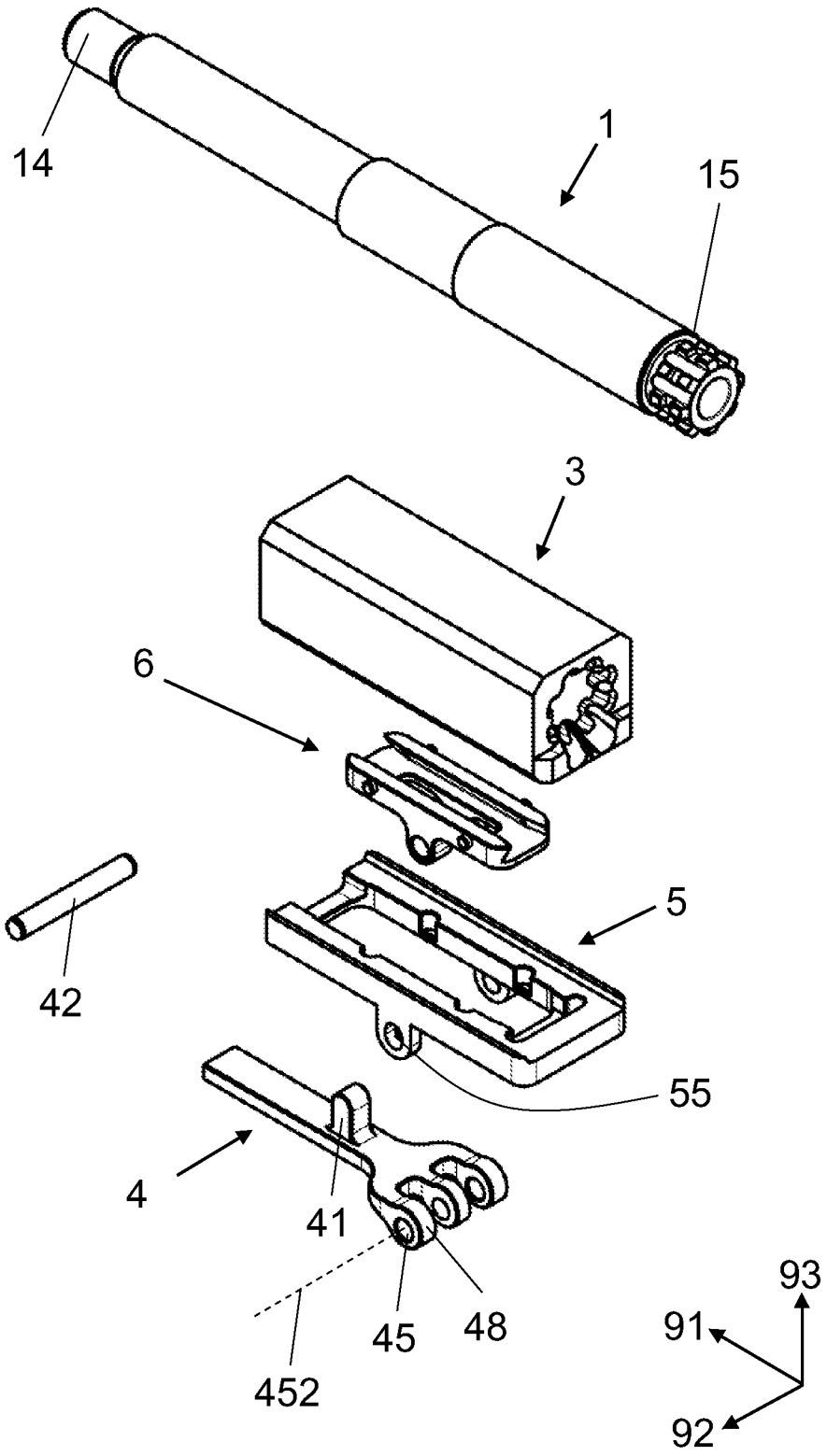
FIG. 3 shows a simplified exploded view of a barrel with a barrel extension and a tension lever group according to the present disclosure.

FIG. 3 shows an exploded view of a barrel 1 with a barrel extension 3 and the clamping device according to the present disclosure consisting of a tension lever 4, a seat 5 and a clamp 6, which are connected to one another by a pin 42 and are arranged in the receiver 2, preferably in the upper receiver 21. It is irrelevant for the present disclosure whether the seat 5 is present as a separate part of the upper receiver 21 or whether it is formed integrally with receiver 2 since the function of the seat 5 is to act as a stationary or receiver-fixed receptacle for the clamp 6.

Figure 9A:
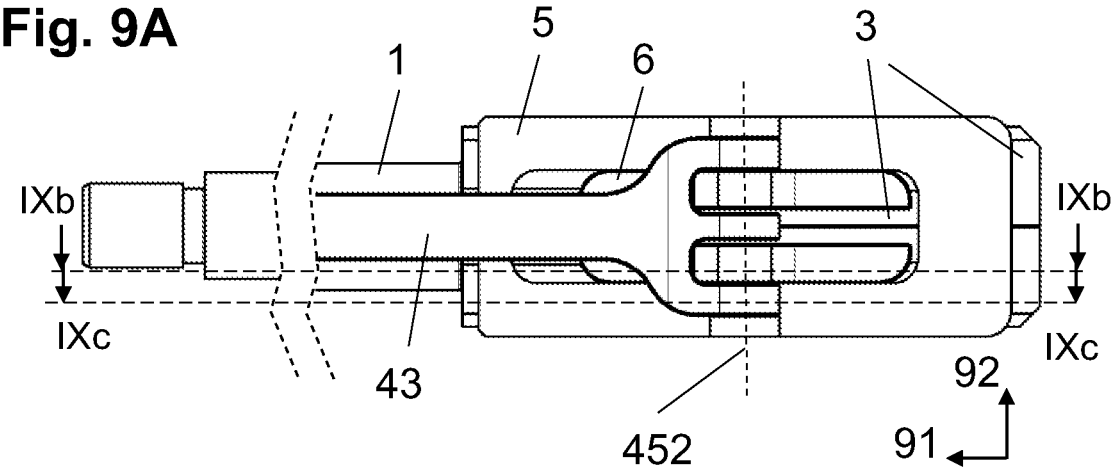
FIGS. 9A to 9C show a bottom view of the illustrative clamping device and corresponding longitudinal sections.
Figure 9B:
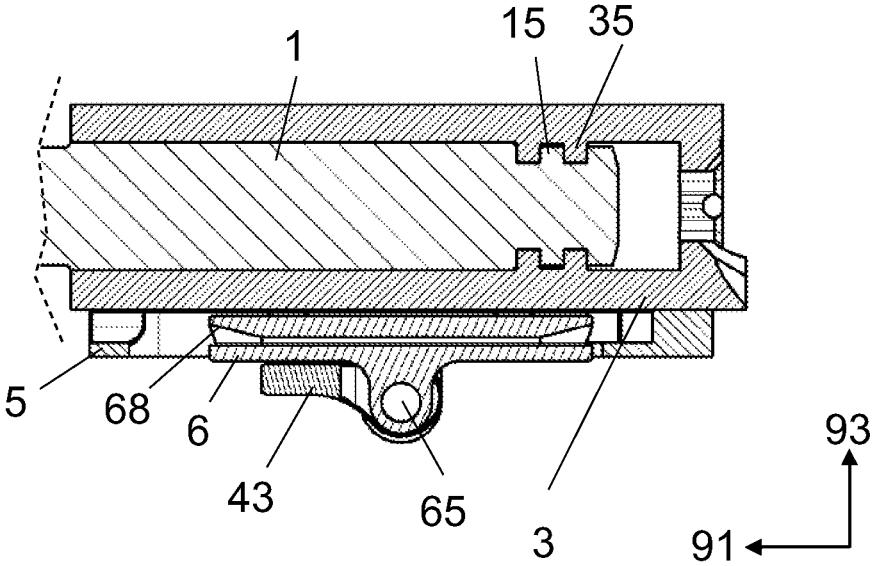
Figure 10A:
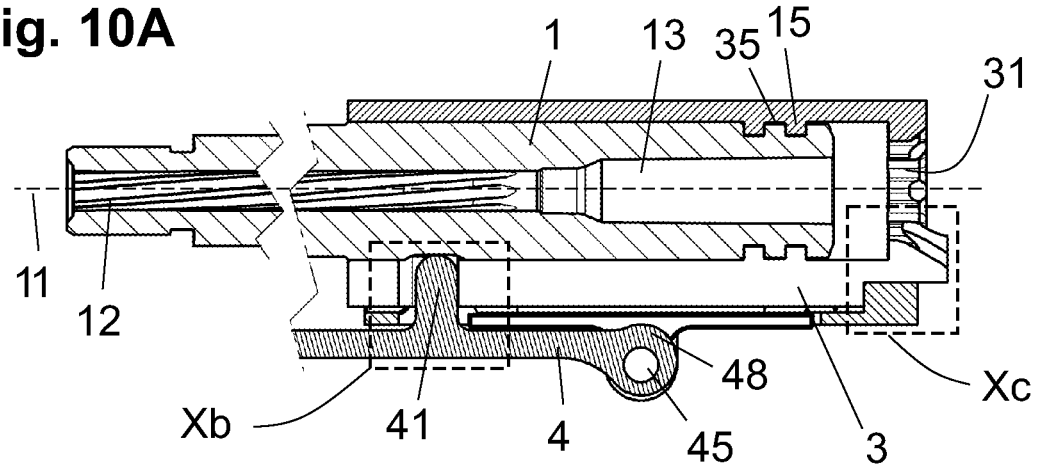
FIGS. 10A to 10C show sectional representations corresponding to FIG. 8 in a longitudinal section.

As can be easily seen from FIG. 3 in conjunction with FIGS. 9B and 10A, the rear end of the barrel 1 has various projecting lugs 15 distributed radially "outwards" on the circumference, which are formed to interact with radially "inward" protruding barrel locking lugs 35 that are complementary in form with the barrel extension 3. This way, the barrel 1 can be fastened in the forward direction of movement 91, for example in the manner of a bayonet lock, by being inserted and rotated in the barrel extension 3 in the axial direction. Other fastening options, such as a thread made to be screwed in, are also known from prior art. It should be explicitly pointed out at this point that, in a preferred variant, the barrel 1 and the barrel extension 3 are formed in one piece, i.e., integrally, with one another.

Furthermore, the manner of assembling or introducing the barrel assembly consisting of the barrel 1 and the barrel extension 3 into the upper receiver 21 can be derived from FIG. 3 in conjunction with FIGS. 2 and 8, 9, 10 and 11. For the sake of simplicity, the upper receiver 21 is not shown in the following illustrations, wherein the seat 5 can be used as a receptacle fixed to the receiver 2 in this regard as a relative reference. At this point, not bothering the present disclosure, reference is made to the explanations of the EP application EP19201455.

Figure 4A:
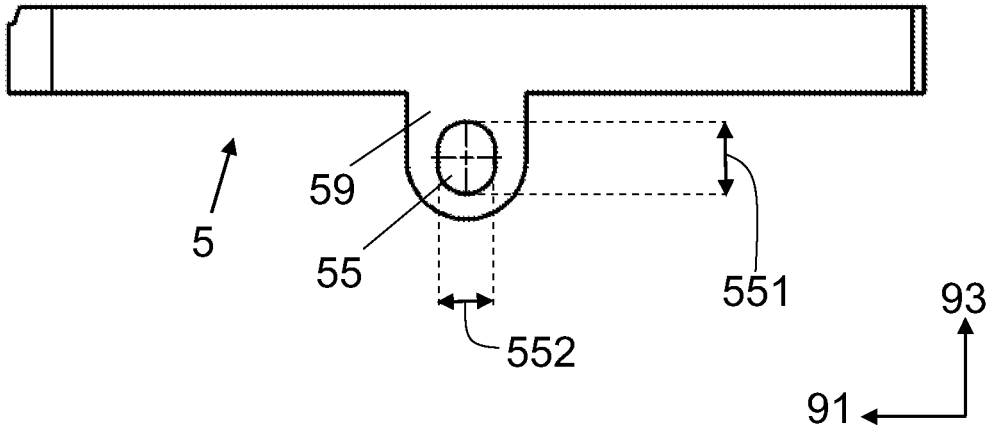
FIGS. 4A and 4B show a detailed view of an illustrative seat in a side plan view and in a 3D illustration.
Figure 4B:
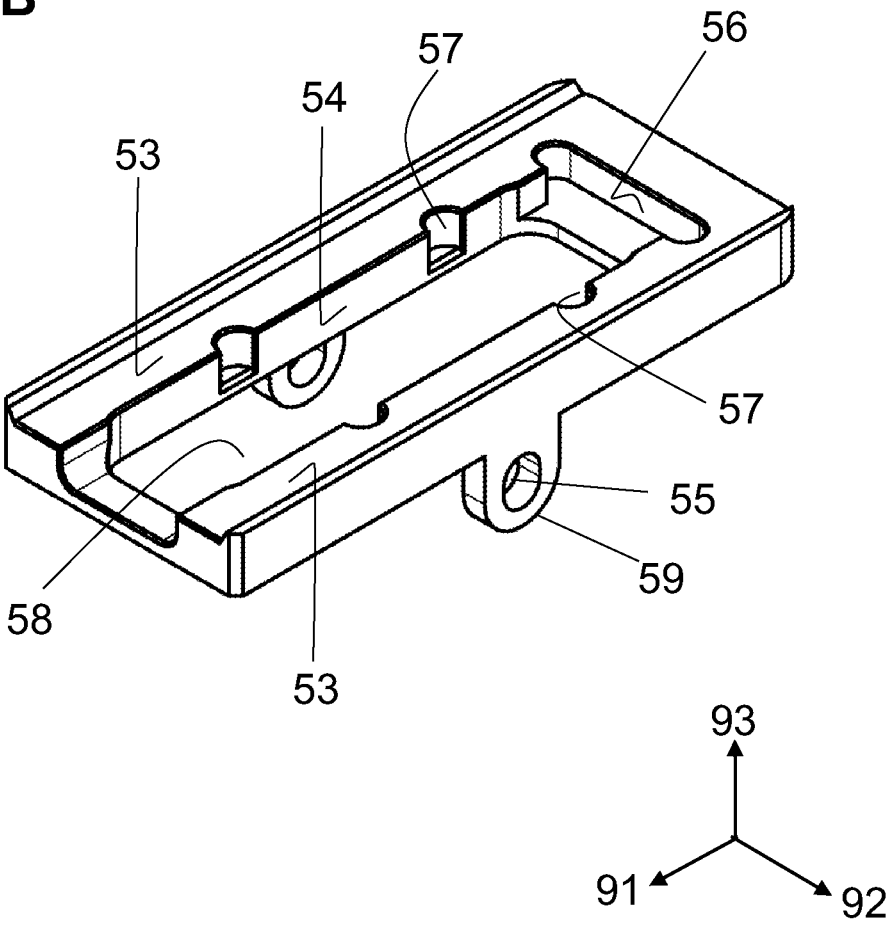

An exemplary embodiment of a seat 5 is shown schematically as a side view in FIG. 4A and without receiver 2 and can be seen particularly well in the perspective view in FIG. 4B. At least one slotted hole 55 for receiving the pin 42 in the transverse direction 92 is formed on the seat 5—also refer to FIG. 8A.

It should be noted at this point that the embodiment of the seat 5 shown in most of the figures shows a further optional feature with two lugs 59, which are formed on the underside of the seat 5 and in which the slotted holes 55 are arranged. Likewise, the designs of only one lug 59 or a plurality of lugs 59 as well no lugs at all are likewise conceivable, in which case at least one slotted hole 55 leads directly through the seat 5 as a through hole. The modification of the specific embodiment of the seat 5 can thus be carried out relatively easily by a person skilled in the art on the basis of the explanations provided here, taking into account the geometric boundary conditions in the overall concept, in particular the overall height of a firearm to be developed.

In the preferred case where the slotted hole 55 is formed on the seat 5, the slotted hole 55 has a width 552 which substantially corresponds to a diameter D1—451—of the clamping lever hole 45 and/or the clamp hole 65, and whose length 551 is 1.1 to 2.5 times, preferably 1.2 to 1.5 times the width 552. Due to the common pin 42, the tension lever 4, the clamp 6 and thus also the barrel extension 3 can, within limits, be tensioned downwards in the vertical direction 93 into the ready-to-fire position or deflected upwards to release the barrel extension 3 in the forward direction of travel 91. The relative position can, in particular, be defined by the length 551 of the slotted hole 55 and the relative position to the clamping lever hole 45 and/or the clamp hole 65. In addition, the relative position and the insertion play can be influenced by the design and arrangement of the prismatic guide surface 321 of the barrel extension 3 and the corresponding clamping surface 62 of the clamp 6. It should be mentioned at this point that the formation of the prism 32 on the barrel extension 3 can also take place in an analogous manner on the clamp 6, as will be explained below.

The seat 5 in FIGS. 2 and 4 also comprises a clamp receptacle 58 through which the clamp 6 protrudes through the seat 5 in the installed state. The lateral guide surfaces 54 of the clamp receptacle 58 serve to guide the clamp 6 in the vertical direction 93. The seat 5 also comprises at its rear end a rear stop 56 which, in the ready-to-fire state, serves to support the barrel extension 3 relative to the upper receiver 21. In analogy to the description above, this rear stop 56 may, if the seat 5 is formed integrally in the receiver 2, mutatis mutandis, likewise be formed directly, for example, on the upper receiver 21. The clamp receptacle 58 may also have a delimitation and guide for the clamp 6 toward the front in the forward direction 91, as schematically indicated for example in FIG. 2B with the help of a transverse web.

In addition, a special embodiment can be seen in FIG. 4B, according to which various guide grooves 57 are formed, which serve as guides for corresponding guide extensions 67 on the clamp 6 in the vertical 93 and/or transverse 92 and/or forward barrel direction 91. This becomes clear from the synopsis with the clamp 6 shown as in FIG. 5 as an example.

Figure 5A:
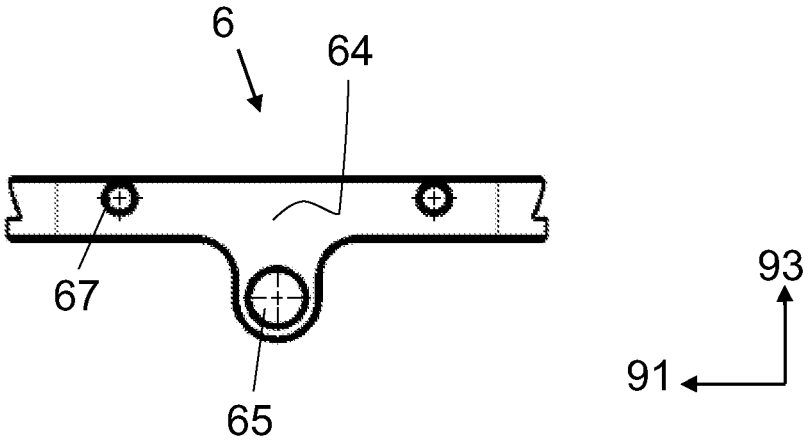
FIGS. 5A to 5C show an illustrative clamp in a side plan view and in 3D views.
Figure 5B:
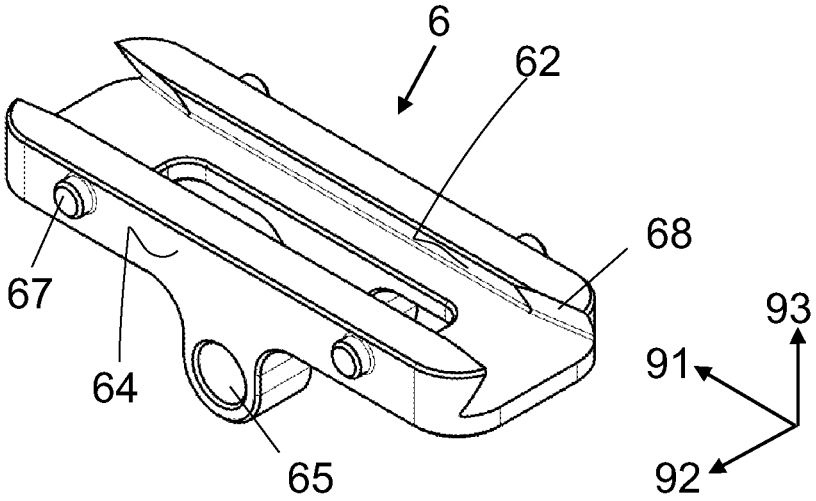
Figure 5C:
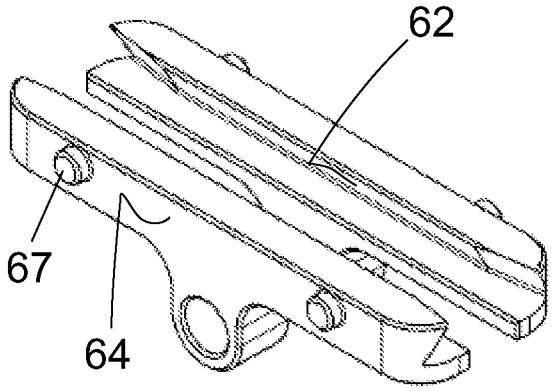

FIG. 5 shows different embodiments of a clamp 6. In the side view in FIG. 5A, the formation of the clamp hole 65 in the transverse direction 92 can be clearly seen. FIG. 5B shows a one-part clamp 6 and FIG. 5C shows a two-part clamp 6. The advantage of the one-piece variant is the high mechanical stability of the component. The advantage of the two-part variant can be, on the one hand, that the production of two identical, but oppositely arranged, partial clamps can, under certain circumstances, be carried out very economically. On the other hand, any manufacturing tolerances that can lead to inaccuracies in the positioning in the transverse direction 92 can be compensated for by the option of the lateral displacement along the pin 42 of the partial clamps when actuating the tension lever 4 by a self-centering on the clamping surfaces 62. In both cases, the perspective illustration clearly shows that, in the direction of the weapon center plane, i.e., substantially parallel to the barrel axis 11, clamping surfaces 62 are designed as prismatic guide surfaces 321 which are configured to be complementary in form and function so that they can interact with a prism 32 of the barrel extension 3 (refer, for example, to FIG. 7). In this case, these clamping surfaces 62 are oriented "inward" in the direction of the weapon center plane.

Furthermore, the preferably designed guide extensions 67 are formed on the (partial) clamps 6 in FIG. 5, as explained above.

Depending on the embodiment, a person skilled in the art can accordingly optimize the position and number of the clamp holes 65 of the clamp 6, mutatis mutandis, to the seat 5 or the tension lever 4 explained below.

In a particularly preferred embodiment, the clamping surfaces 62 in the insertion area are tapered, or beveled, outwards in the forward direction 91, as can be seen from FIGS. 5B and 5C, which makes it possible to simplify the insertion of the prism 32 of the barrel extension 3. These tapers 68 can be seen very clearly in FIGS. 5B and 9B and can be formed on one side or on both sides.

Figure 7:
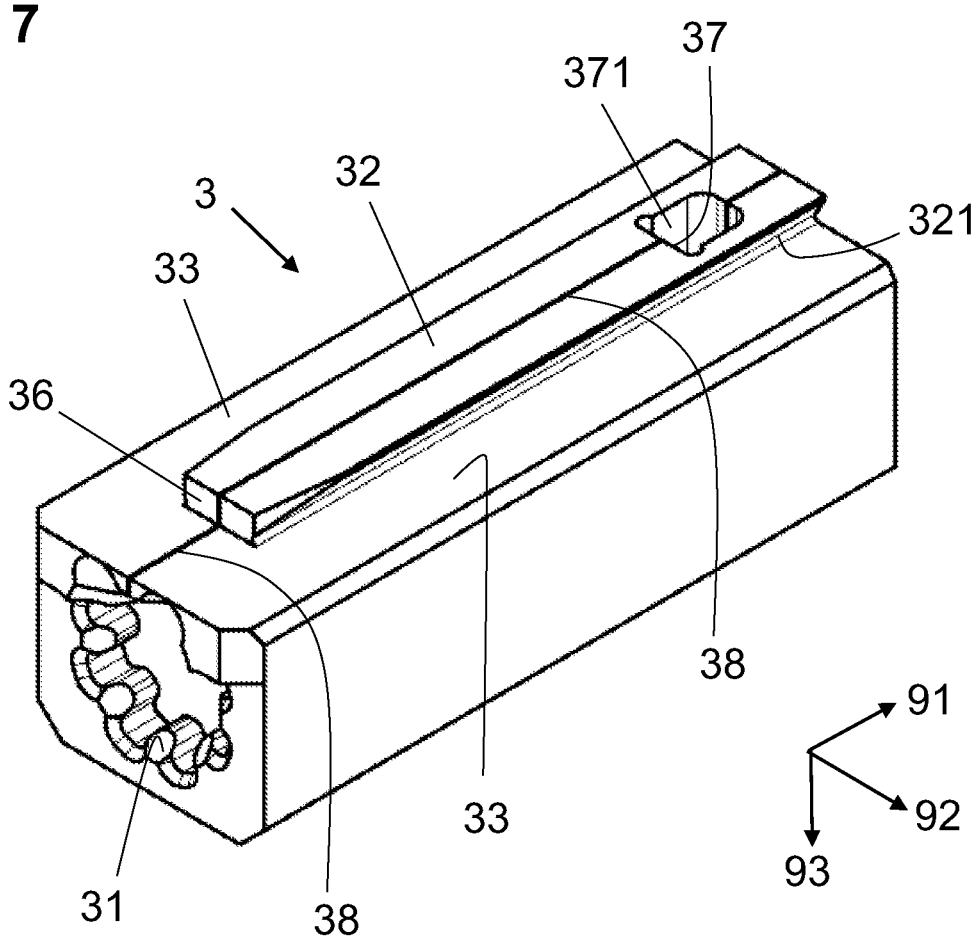
FIG. 7 shows an illustrative barrel extension in a 3D view from below.

In a manner similar to that of these tapers 68 on the clamp 6, it can be advantageous, as can be seen in FIG. 7, that the prism 32 is designed such that it tapers, or is beveled, in the end region toward the rear stop surface 36 and in the transverse direction 92. This measure can facilitate the introduction of the barrel extension 3 as well.

Figure 6A:
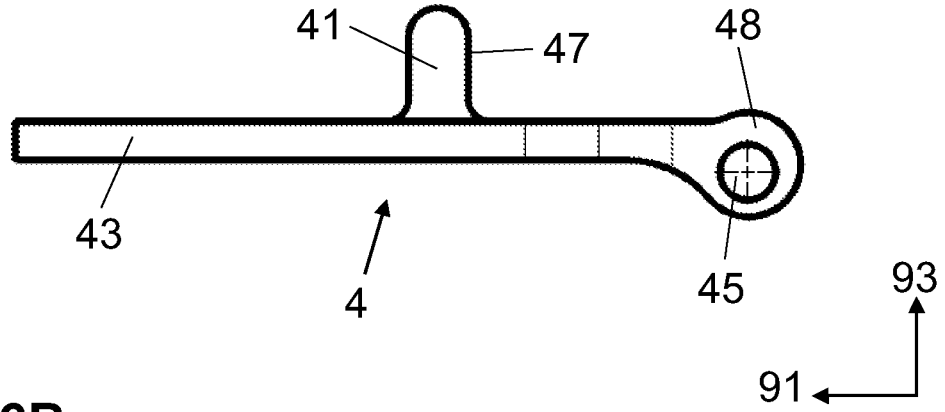
FIG. 6A shows a detailed view of an illustrative tension lever in a side plan view. Additional embodiments of the tension lever of the present disclosure are shown in FIGS. 6B and 6C.
Figure 6B:
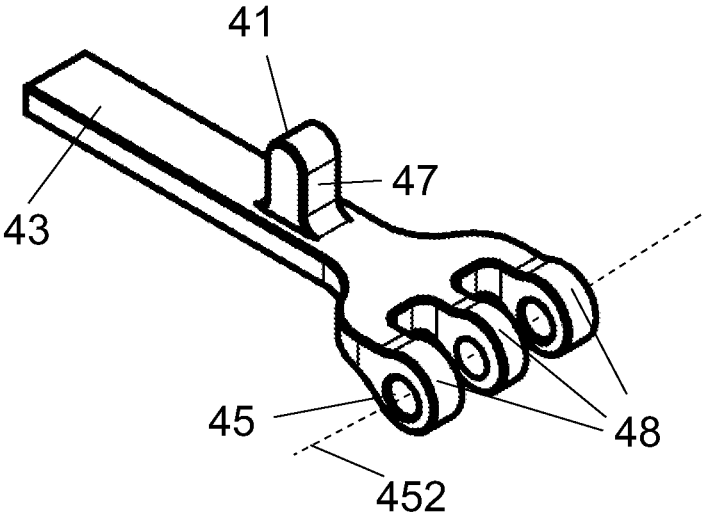
Figure 6C:
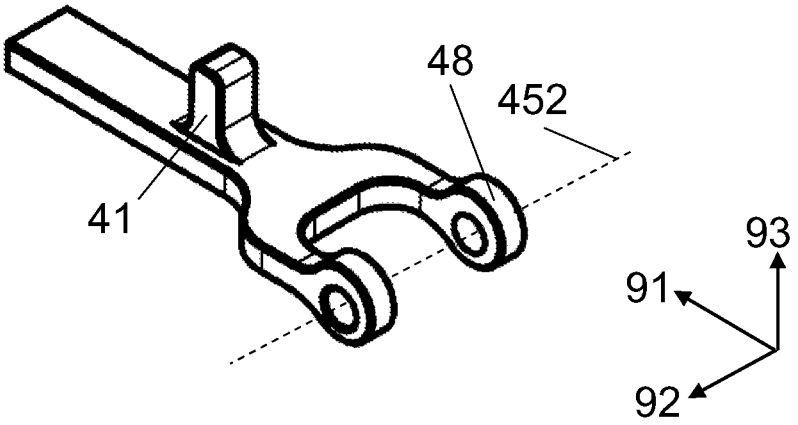
Figure 8A:
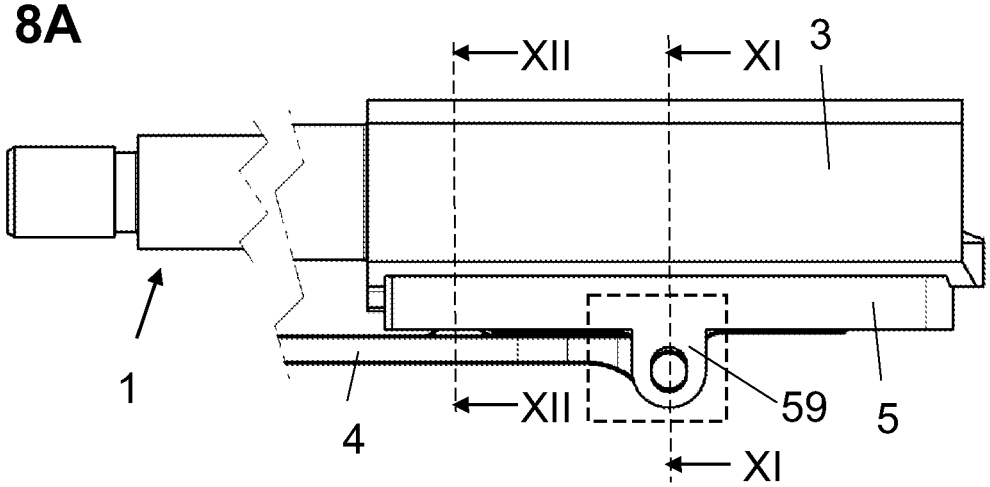
FIGS. 8A to 8C show detailed views of an illustrative barrel with a tension lever group according to the present disclosure in a side plan view and from the front.
Figure 8B:
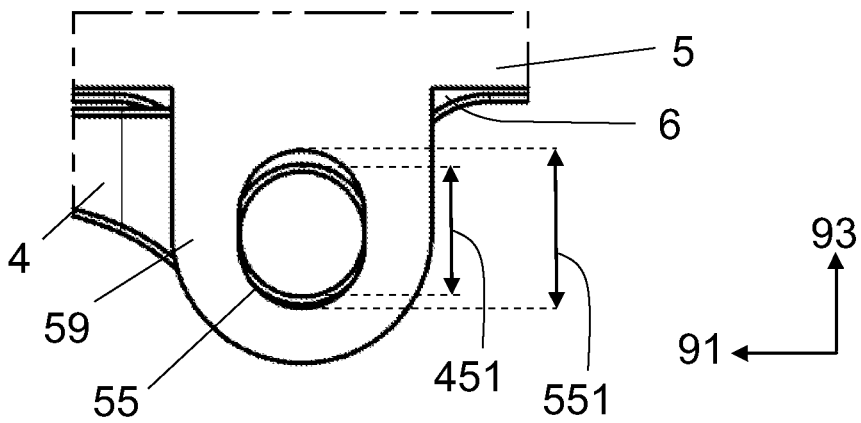
Figure 8C:
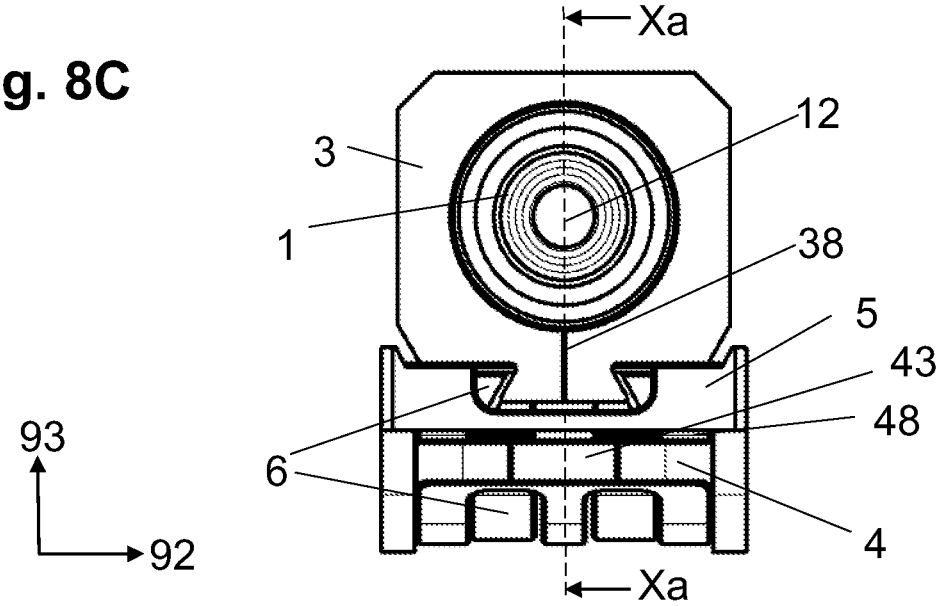

FIG. 6 shows an exemplary tension lever 4. The tension lever 4 comprises an elongated grip 43 and at least one clamping lever hole 45 which, when installed, runs normal to the forward direction 91 in the transverse direction 92 and coincides with the common axis of rotation 452 of the clamp 6. An extension is formed on the tension lever 4 which, in the closed state, has a front stop surface 37 pointing upwards substantially in the vertical direction 93; refer to FIG. 10B. This extension is referred to as a cam 41 and can—as explained below—have several functions. Furthermore, on the tension lever 4, preferably on the outside in the area of the clamping lever hole 45, a link-like clamping section 48 extending eccentrically to the clamping lever hole 45 is formed. The course of the clamping section 48 is selected such that, in the ready-to-fire state, the tension lever 4 biases the clamp 6, which is jointly connected to the pin 42, in the vertical direction 93 by supporting the clamping section 48 on the seat 5. In the dismantling position, i.e., with the tension lever 4 open, the clamping section 48 and the cam 41 lie entirely outside the path of movement of the barrel extension 3 in the forward direction of travel 91, see FIGS. 2A and 2B.

To explain the mode of operation of the clamping mechanism, reference is primarily made to a synopsis of FIGS. 2 to 11. FIG. 8A provides an exemplary side view, and FIG. 9A provides a bottom view of the clamping mechanism without a receiver 2. FIG. 8B shows the detail from FIG. 8A, in which it can be clearly seen that, when the tension lever 4 is closed, the relative position of the clamping lever hole 45 or the aligned clamp hole 65, lies within the slotted hole 55. If the clamping section(s) 48 are pressed from below against the seat 5 when the tension lever 4 is turned over, the barrel extension 3, which is gripped by the clamp 6 by means of the prismatic guide surfaces 321, 62, is pulled down in the vertical direction and clamped there. A person skilled in the art can easily imagine that the "lower end" of the slotted hole 55 does not necessarily have to serve as a support for the pin 42, as it is clearly shown in the side view of FIG. 8B, but primarily forms a guide in the vertical direction 93. This is analogous to the previously described basic idea, see FIG. 2.

Figure 9C:
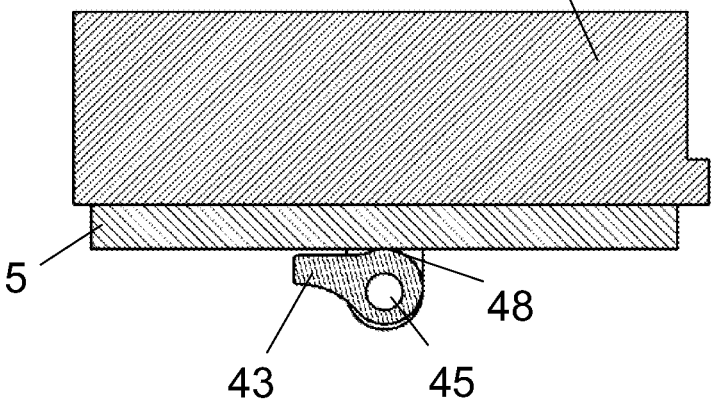

In FIG. 9C, the clamping device is shown in the ready-to-fire state—without the receiver 2—from the "front" in the forward direction of travel 91 to the rear. Due to the previously explained clamping sections 48, and the pressure against the seat 5, the tension lever 4 applied causes the clamping of the clamp 6 in the downward direction. From this view, the interaction of the prismatic guide surfaces 321, 62, as well as their position parallel to the barrel bore 12 or the barrel axis 11 (compare also FIG. 10), can also be recognized very well. In addition, FIG. 9C shows a longitudinal section along the line IXc from FIG. 9A, which illustrates the biasing of the clamping section 48 on the seat 5 very well; see in combination with FIGS. 2A and 2B. FIG. 9B shows a longitudinal section along the line IXb, which, somewhat closer to the weapon center plane, discloses a section through the clamping device in the area of a clamp 6. As previously explained, the clamp hole 65 and the clamping lever hole 45 lie on the common axis of rotation 452, which lies within the slotted hole 55 of the seat 5.

FIG. 10*a* shows a longitudinal section X through the weapon center plane of FIG. 9C, in which the axial attachment of the barrel 1 or the barrel extension 3, respectively, which occurred in the running direction, can be seen very clearly. The cam 41 formed on the elongated grip 43 of the tension lever 4 has a rear contact surface, hereinafter referred to as the front stop 47, which serves to as a support or a contact of the front stop surface 37 of the barrel extension 3. This detail Xb is shown enlarged in FIG. 10B and has the effect that, in the ready-to-fire position, the barrel extension 3 is biased with a rear stop surface 36 against the seat 5, or possibly directly the receiver 2, as can be seen from detail Xc in FIG. 10C.

Figure 10B:
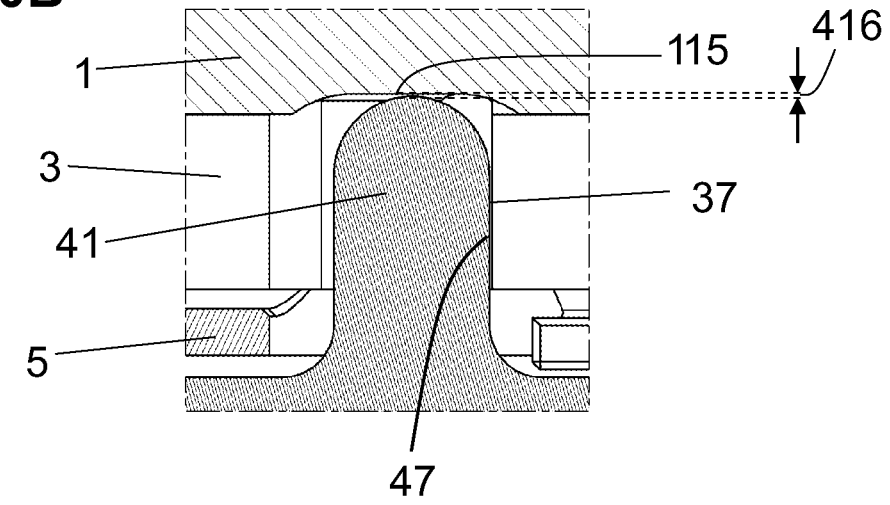
Figure 10C:
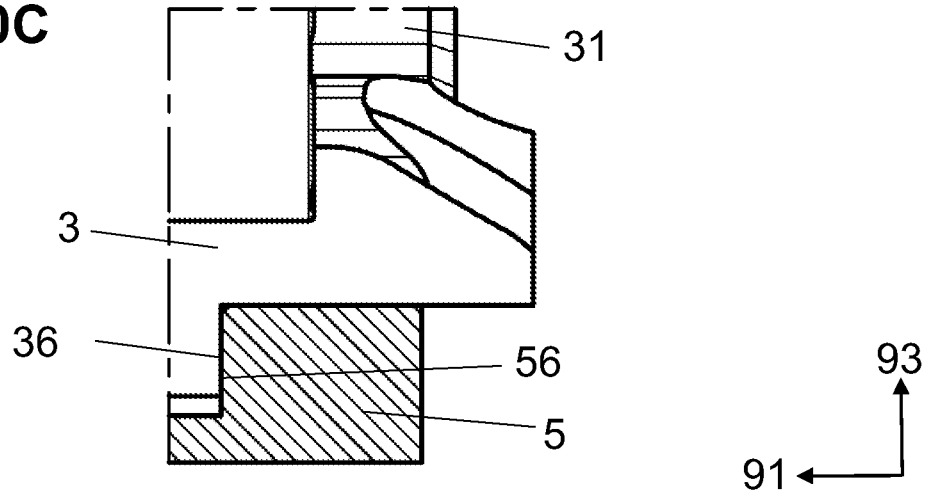
Figure 11A:
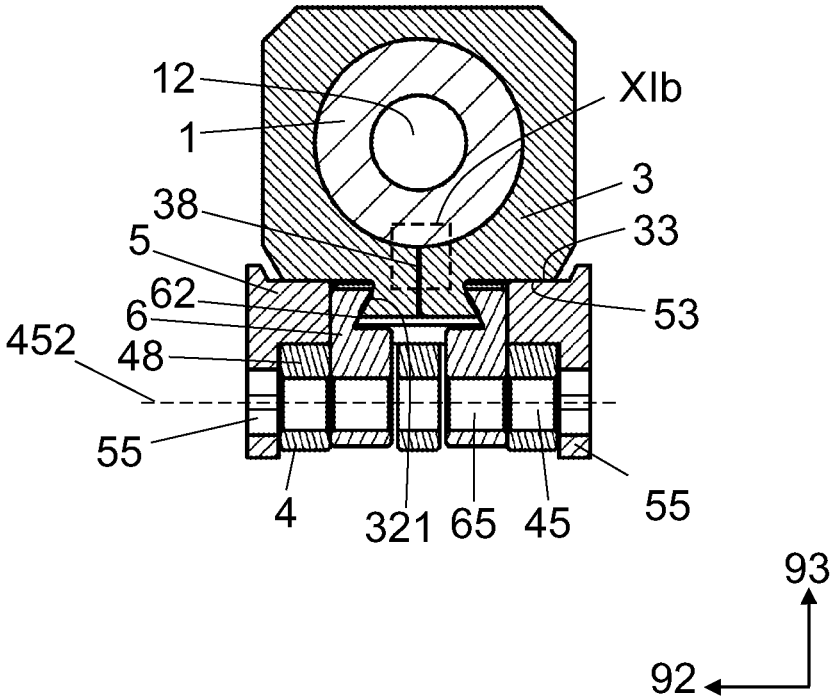
FIGS. 11A and 11B show cross-sectional representations corresponding to FIG. 8.
Figure 11B:
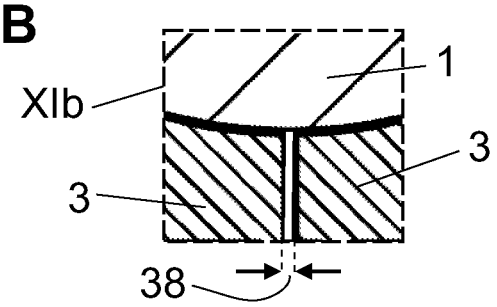
Figure 12A:
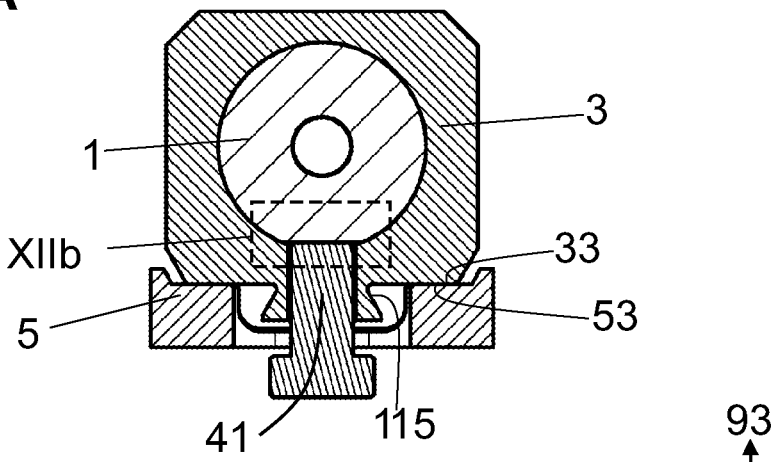
FIGS. 12A and 12B show cross-sectional representations corresponding to FIG. 8.
Figure 12B:
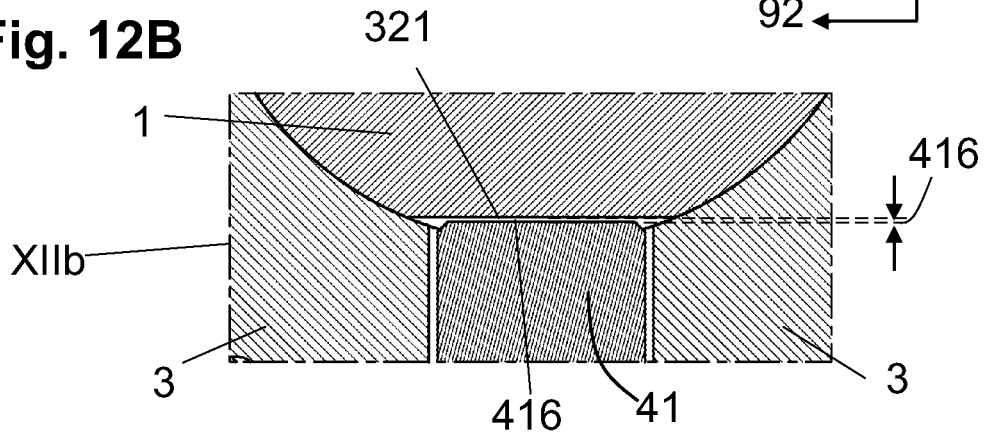

A further preferred embodiment can be seen very clearly in FIG. 10B in combination with FIG. 12B, according to which the barrel 1 has a flattened region 115 on a side facing the cam 41 in the ready-to-fire state. Depending on the shape of the cam 41, other shape-complementary recesses can be formed as well. A cross section along XII-XII from FIG. 8A in the area of engagement of the cam 41 can be seen in FIG. 11A. In the area of the flattened region 115, the barrel 1 should, in the ready-to-fire position, be at a distance from the tip of the cam 41 by a clearance 416; see also FIG. 12B. In this arrangement, the barrel 1 is secured against rotation in the barrel extension 3, since when the tension lever 4 is open, the cam 41 is out of engagement with the flattened region 115 of the barrel 1, making the barrel 1 easy to mount. Due to the shape-complementary design of the flattened region 115 of the barrel 1, the tension lever 4 can only be closed when the barrel 1 is aligned in the barrel extension 3 in a predetermined position. A kind of "end position control" of the barrel 1 can thus be achieved in a simple manner. It has proven to be advantageous if the clearance 416—if provided—is only a few hundredths of a millimeter, preferably 0.02 to 0.40 mm, particularly preferably from 0.10 to 0.20, as can also be seen in the detail XIIb of FIG. 12A as shown in FIG. 12B.

Looking at FIGS. 3 and 6 together, a further special embodiment can be seen, according to which the shape of the cam 41 has a flattened region at the tip in the transverse direction 92. Although the cam 41 could also be pointed and/or rounded, with only a point contact to the barrel 1 being formed in the event of a rotation, it may be advantageous to design the cam 41 to be flattened in the transverse direction 92 and/or the forward direction 91 in order to make a linear or surface contact with barrel 1 possible. This can be of particular advantage if no clearance 416 is provided in order to reduce the tension in the barrel 1 when it is jammed.

It should be pointed out at this point that it is incumbent on the person skilled in the art to adapt the shape and number of cams 41 to the corresponding task in accordance with the present object. The shape and number of clamping sections 48 of the tension lever 4 can be optimized as well. It has proven to be particularly advantageous to form two clamping sections 48 since in this way the local surface pressure on the seat 5 can be reduced. This can be advantageous for the useful life of the clamping device. It is of course also possible to provide three or more clamping sections 48.

FIG. 7 and FIG. 10A show a further particular embodiment, according to which the front stop surface 37 of the barrel extension 3 is formed on the underside of the barrel extension 3 in a cam receptacle 371 provided for this purpose. In principle, the front stop surface 37 could also be provided on the end face of the barrel extension 3, but this cam receptacle 371 can have the advantage that a reduced overall size or length of the clamping device can be achieved.

The preceding description includes various exemplary embodiments for a barrel extension 3 which, as can be clearly seen in FIG. 7 and FIG. 11A, preferably has a dovetail-like prism 32 for forming the prismatic guide surfaces 321. In a particular embodiment of the present disclosure, the barrel extension 3 may have at least one slot 38, preferably formed parallel to the forward direction 91. This slot 38 is formed on at least one side of the barrel extension 3, preferably starting from the weapon center plane outwards across the entire length of the barrel extension 3, and causes the biasing of the clamp 6 to cause a tangential tapering of the slot 38 when the tension lever 4 is closed. In this way, in addition to being secured via the projecting lugs 15, the barrel 1 can be fixed in the barrel extension 3 via a flat clamping. This can be advantageous with regard to the introduction of the forces into the seat 5 or the receiver 2 of the firearm when the shot is fired. It is particularly advantageous if the slot 38 is not completely closed when the clamping is carried out, in order to prevent any biasing of the barrel extension 3.

Figure 13:
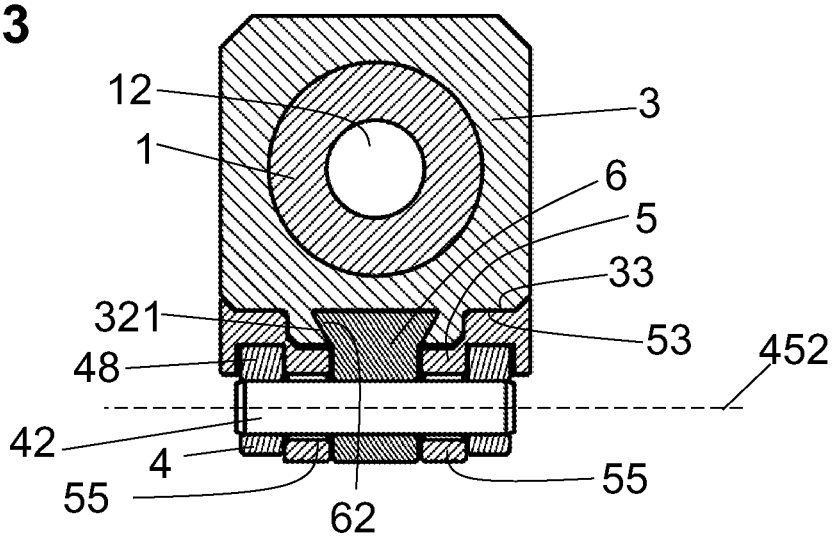
FIG. 13 shows an analogous embodiment with a prism on the clamp.

In an alternative embodiment, the effective direction of the prismatic guide surfaces 321, i.e., the clamping surface 62 of the clamp 6 and the prismatic guide surface 321 of the barrel extension 3, is reversed from the preceding description. All of the previously described embodiments can be used mutatis mutandis. An example of such an arrangement is shown schematically in FIG. 13. Such an arrangement may, under certain circumstances, result in certain advantages with regard to the reduced overall height of the clamping device, which are relatively easy for a person skilled in the art to apply on the basis of the aforementioned examples. The formation of a slotted barrel extension 3 is conceivable, but such an arrangement would lead to a reduction in the contact surface between the barrel 1 and the barrel extension 3 during clamping, which is why it should only be used in special arrangements.

A person skilled in the art can easily understand from the above description that, with the described clamping device, the barrel extension 3 and/or the barrel 1 can be clamped in the ready-to-fire position effectively and with repeat accuracy, but can also be exchanged relatively easily if necessary. The barrel 1 can be removed from the receiver 2 (not shown in greater detail) when the tension lever 4 is open. It is therefore possible to use both a barrel extension 3, matching the clamp 6, to accommodate different barrels 1 with, for example, different calibers, or, in the case of barrel extensions 3 integrally formed on the barrel 1, to exchange the corresponding barrels 1 with little manual effort and to position them in the receiver 2 with repeat accuracy.

The present disclosure is not limited to the illustrated and described exemplary embodiments, but can be modified and configured in various ways. In particular, the shown cross-sectional shapes of the mentioned receiver parts, pins, rails, recesses, etc. can be adapted to the given basic data, and the lengths and the positions with respect to the receiver can also be easily adapted by a person skilled in the art with knowledge of the present disclosure. In particular, equivalent designs are obvious with knowledge of the disclosure and can be carried out without further ado by a person skilled in the art.

It should also be noted that in the description and the claims, terms such as the "lower region" of an object, refer to the lower half and in particular the lower quarter of the overall height; "lowermost region" refers to the lowermost quarter and in particular an even smaller part, while "central region" refers to the central third of the overall height. For the terms "width" or "length," this applies mutatis mutandis. All of these terms have their generally accepted meaning applied to the intended position of the object under consideration.

In the description and the claims, "substantially" means a deviation of up to 10% of the stated value, if physically possible, both downward and upward, otherwise only in the appropriate direction; in the case of degrees (angle and temperature), and for indications such as "parallel" or "normal," this means±10°. If there are terms such as "substantially constant" etc., what is meant is the technical possibility of deviation which the person skilled in the art takes as a basis and not the mathematical one. For example, a "substantially L-shaped cross-section" comprises two elongated surfaces which merge at one end into the end of the other surface and whose longitudinal extension is arranged at an angle of 45° to 120° to one another.

All given quantities and percentages, in particular those relating to the limitation of the present disclosure, insofar as they do not relate to specific examples, are understood to have a tolerance of ±10%; accordingly, for example: 11% means 9.9% to 12.1%. With terms such as "a solvent," the word "a" is not to be considered to represent a singular numeral, but rather is to be considered an indefinite article or pronoun, unless the context indicates otherwise.

Unless otherwise stated, the term "combination" or "combinations" mean all types of combinations, starting from two of the relevant components up to a plurality or all of such components; the term "containing" also means "including," "having," or "comprising."

The features and variants stated in the individual embodiments and examples can easily be combined with those of the other examples and embodiments and in particular can be used for characterizing the present disclosure in the claims without necessarily including the other details of the particular embodiment or of the particular example.

LIST OF REFERENCE SIGNS

| | |
|---|---|
| 1 | Barrel |
| 11 | Barrel axis |
| 12 | Bore |
| 13 | Cartridge chamber |
| 14 | Muzzle |
| 115 | Flattened region |
| 15 | Projecting lugs |
| 2 | Receiver |
| 21 | Upper receiver |
| 22 | Lower receiver |
| 3 | Barrel extension |
| 31 | Locking lugs |
| 32 | Prism |
| 321 | Prismatic guide surface(s) |
| 33 | Bottom |
| 34 | |
| 35 | Barrel locking lugs |
| 36 | Rear stop surface |
| 37 | Front stop surface |
| 371 | Cam receptacle |
| 38 | Slot |
| 4 | Tension lever |
| 41 | Cam/nose |
| 416 | Clearance |
| 42 | Pin |
| 43 | Elongated grip |
| 45 | Clamping lever hole |
| 451 | Diameter D1 |
| 452 | Common axis of rotation |
| 47 | Front stop |
| 48 | Clamping section(s) |
| 5 | Seat |
| 55 | Slotted hole(s) |
| 551 | Length |
| 552 | Width |
| 53 | Rest surface |
| 54 | Lateral guide surface |
| 56 | Rear stop |
| 57 | Guiding groove(s) |
| 58 | Clamp receptacle |
| 59 | Lug(s) |
| 6 | Clamp |
| 62 | Clamping surface |
| 64 | Outer surface |
| 65 | Clamp hole |
| 67 | Guiding extension(s) |
| 68 | Taper(s)/Bevel(s) |
| 81 | Handguard |
| 82 | Trigger |
| 83 | Magazine well/holder |
| 84 | Grip |
| 85 | Buttstock/shaft |
| 91 | Forward/Barrel direction (front) |
| 92 | Transferse direct6ion (left) |
| 93 | Vertical direction (up) |

The invention claimed is:

1. A firearm, comprising:

an upper receiver, including at least one barrel having a barrel axis, a barrel extension that can be connected to the barrel, a locking mechanism, and a firing pin mechanism; and a lower receiver, including at least one grip, a magazine, and a trigger mechanism;

the firearm being configured so that when the firearm is in an assembled and ready-to-fire state the upper receiver and the lower receiver are connected to one another;

wherein the barrel extension is connected directly to the upper receiver using a clamp, or the barrel extension is connected to the upper receiver via a seat using the clamp;

wherein the barrel extension defines a prism, and the clamp defines corresponding prismatic guide surfaces running parallel to the barrel axis when the firearm is in the assembled and ready-to-fire state;

the barrel extension is fastened on the upper receiver by a tension lever, the tension lever being rotatable in the upper receiver about a common axis of rotation that extends normal to a weapon center plane between two end positions corresponding to the assembled and ready-to-fire position and a dismantling position, the tension lever further including at least one clamping section, an elongated grip, and a cam formed on the tension lever;

the clamp and the tension lever are connected by a pin along the common axis of rotation through at least one clamp hole or clamping lever hole that extends normal to the weapon center plane;

when the firearm is in the assembled and ready-to-fire position, the barrel extension rests with a rear stop surface on the seat, when present, so that the barrel extension is clamped backwards by the cam against a forward direction of travel, and the clamping section biases the clamp in a vertical direction; and when the firearm is in the dismantling position, the clamping section and the cam lie entirely outside a path of movement of the barrel extension in the forward direction of travel.

2. The firearm according to claim 1, wherein the seat, when present, defines at least one slotted hole.

3. The firearm according to claim 2, wherein the slotted hole has a width that substantially corresponds to a diameter D1 of the clamping lever hole and/or the clamp hole, and a length of the slotted hole corresponds to 1.1 to 2.5 times the width of the slotted hole.

4. The firearm according to claim 3, wherein the length of the slotted hole corresponds to 1.2 to 1.5 times the width of the slotted hole.

5. The firearm according to claim 1, wherein the barrel extension defines at least one slot that extends parallel to a forward direction.

6. The firearm according to claim 1, wherein the barrel defines a flattened region on a side facing the cam that is complementary in shape to the cam when the firearm is in the assembled and ready-to-fire state.

7. The firearm according to claim 6, wherein when the firearm is in the assembled and ready-to-fire state, the cam and the flattened region are spatially separated from one another by a clearance having a width of 0.02 mm to 0.4 mm.

8. The firearm according to claim 6, wherein when the firearm is in the assembled and ready-to-fire state, the cam and the flattened region are spatially separated from one another by a clearance having a width of 0.10 mm to 0.20 mm.

9. The firearm according to claim 1, wherein the cam is flattened in the transverse direction and/or in the forward direction.

10. The firearm according to claim 1, wherein the tension lever includes at least two clamping sections.

11. The firearm according to claim 1, wherein the clamp includes lateral guide extensions, and the seat, when present, defines guide grooves that correspond to the lateral guide extensions.

12. The firearm according to claim 1, wherein the barrel extension defines a receptacle that is configured to receive the cam.

13. The firearm according to claim 1, wherein the clamp includes a plurality of parts.

14. The firearm according to claim 1, wherein the clamp includes exactly two parts.

15. The firearm according to claim 1, wherein the clamp includes a clamping surface, and the clamp is formed with a bevel on at least one side in an insertion area of the clamping surface.

16. The firearm according to claim 1, wherein bevels are formed laterally on the prism of the barrel extension in an end region pointing to a rear stop surface and in the transverse direction.

17. The firearm according to claim 1, wherein the barrel extension is integrally formed on the barrel, or is permanently connected to the barrel.

18. The firearm according to claim 1, wherein the clamp includes a clamping surface, and the clamping surface of the clamp points outward in the transverse direction and a corresponding prismatic guide surface of the barrel extension points inward.

19. The firearm according to claim 1, wherein the upper receiver further comprises a gas operating mechanism.

20. The firearm according to claim 1, wherein the firearm is a rifle.

* * * * *